United States Patent [19]

Benjamin

[11] 4,227,583

[45] Oct. 14, 1980

[54] METHOD AND APPARATUS FOR SINKING SHAFTS

[75] Inventor: Joseph R. Benjamin, London, England

[73] Assignee: Wirth Maschinen-und Bohrgeräte-Fabrik, Fed. Rep. of Germany

[21] Appl. No.: 959,738

[22] Filed: Nov. 13, 1978

[51] Int. Cl.[2] ..... E21B 3/02; E21B 17/00; E21D 1/06; E21D 1/08

[52] U.S. Cl. ..... 175/65; 175/171

[58] Field of Search ..... 175/57, 65, 170, 171, 175/402; 299/33; 405/133, 248, 249; 173/57

[56] References Cited

U.S. PATENT DOCUMENTS

| | | | |
|---|---|---|---|
| 2,641,444 | 6/1953 | Moon | 175/171 X |
| 2,675,213 | 4/1954 | Poole et al. | 175/171 X |
| 3,115,755 | 12/1963 | Siebenhausen | 175/171 X |
| 3,389,560 | 6/1968 | Zemsky | 405/133 X |
| 3,901,331 | 8/1975 | Djurovic | 175/171 |
| 4,055,224 | 10/1977 | Wallers | 175/171 X |

*Primary Examiner*—Stephen J. Novosad
*Attorney, Agent, or Firm*—Holman & Stern

[57] ABSTRACT

Disclosed is a method and apparatus for sinking shafts in which ring-like walling elements used as a shaft shoring are inserted into the shaft concurrently with the drilling thereof. The walling elements are held against rotation by a mechanism at the top of the shaft which sequentially inserts the walling elements into the shaft as dictated by the depth thereof as drilling progresses. The lowermost end of the lowermost walling element is supported on a bearing associated with the shaft drill bit.

13 Claims, 9 Drawing Figures

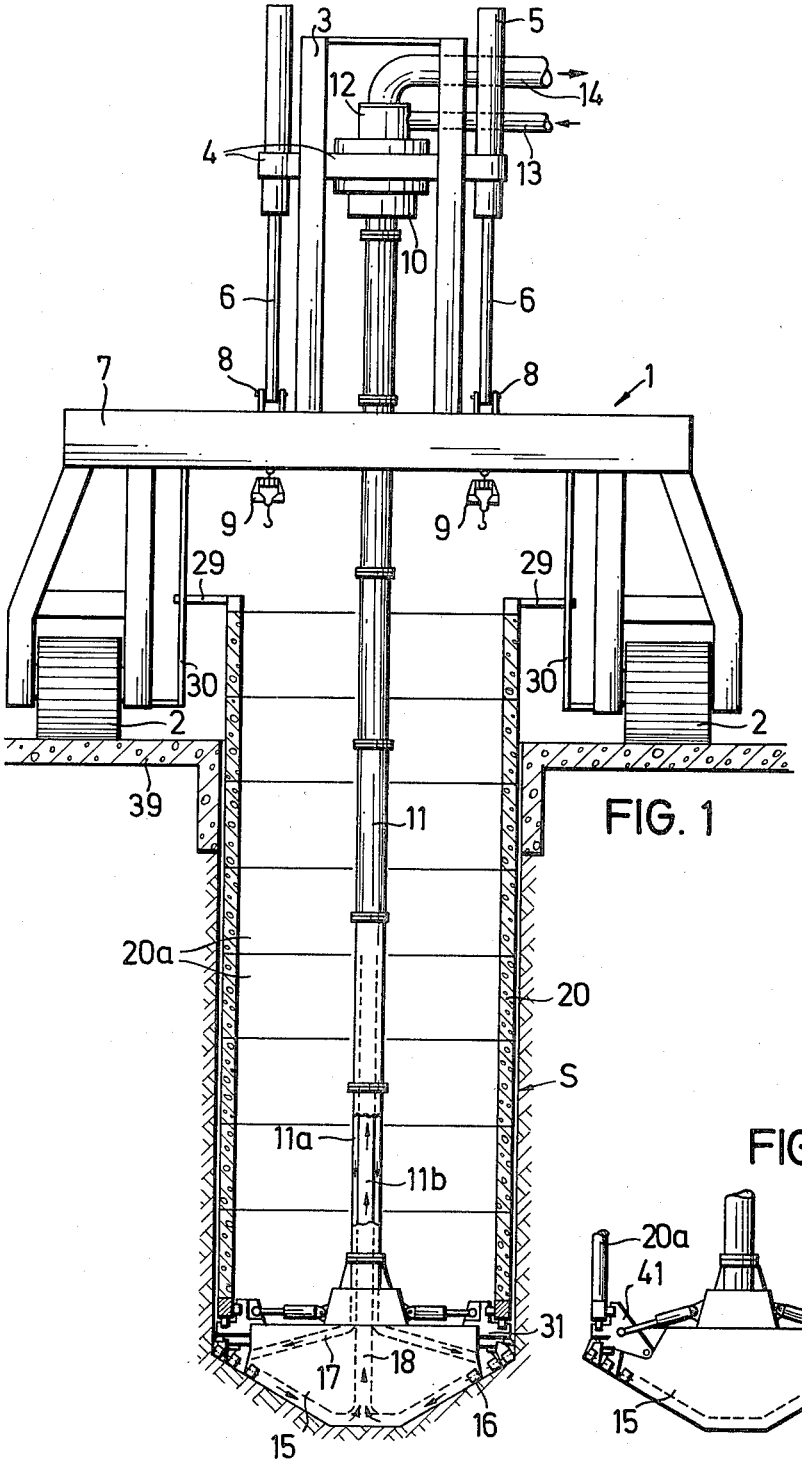
FIG. 1
FIG. 2
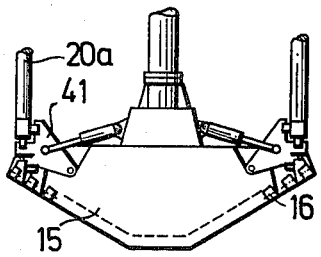

METHOD AND APPARATUS FOR SINKING SHAFTS

BACKGROUND OF THE INVENTION

The instant invention concerns a method and an apparatus for making shafts, whereby a device working from the top towards the bottom is used for sinking the shaft, and the shaft space thus obtained is provided with wallings comprising sections which are connectable with each other and each forming a circle.

In the production of vertical shafts it is known in the art to first drill an initial borehole with a comparatively small diameter and subsequently to widen said initial borehole to a larger diameter, whereby the resultant rocks are removed through the borehole. Such a method, however, is not applicable when it is not desired, or not possible, to drill an initial borehole.

This holds true for all such cases in which a dead-end shaft should be produced. Such type of shafts have in the prior art been sunk using the plate-propulsion method, whereby the rocks had to be loosened by hand and moved upwards by means of a special device. Such a working method is not only costly but it is connected with great danger for the personnel working at the bottom of the shaft.

The installation of wallings in a shaft in the prior art has mostly been accomplished in a manner whereby a special stage or platform is provided at a distance above the working area in which the propulsion work is being performed, with those people located on said platform being charged with the task of assembling the individual sections of the wallings at that area, whereby the additional sections are adjoined to the already installed sections of the walling in a downward direction. Such a method necessitates tremendous costs, it is time-consuming and produces dangers for the workers. Additionally, normally the final walling of the shaft is not yet completed, before there are further measures required, for example the rear-pouring with concrete of a walling consisting of sheet metals in order to obtain the type of a shaft which will be able to withstand the expected stresses and which only then renders the shaft suitable for the respective purposes for which it is designed.

It is an object of the instant invention to overcome the above disadvantages and to provide a method for the favorable production of dead-end shafts with a final walling, whereby the utilization of personnel working in the shaft can be made extensively or even entirely unnecessary.

SUMMARY OF THE INVENTION

The instant invention proposes to sink the shaft by means of a rotating driveable drill head as a full-drilling process, and that the walling is installed as the final walling of the shaft simultaneously with the drilling process, whereby the lower end portion of the lowermost section of the walling, in a position immediately adjacent the drill head and corresponding to the drilling advancement, is moved downwards while most possible thereby preventing a rotation. This method has the advantage that the sinking of the shaft can be accomplished without the need for utilizing manual labor inside the shaft or at its bottom, and that a walling is installed representing a walling of the shaft which can withstand the respective stresses to a full measure, so that the shaft can be completed at least to a great extent practically in one continuous working operation.

A preferred embodiment of the instant invention consists in that the walling is supported on an element associated with the drill head or forming a part of said drill head, and the drill head is thereby stressed with at least a portion of the weight of the walling. This provides the drill head during its operation with the necessary auxiliary force, without the requirement for a special device. Additionally, the walling which finds support on the drill head functions as a long stabilizer means so that the drilling process can be performed with great precision.

Suitably, the drilling process is performed with a drilling rod system carrying at its lower end portion the drill head and obtaining rotational movements by means of a motor, or a power swivel above the shaft. It is however also possible to provide the drill head directly with a rotary drive.

A preferred embodiment calls for the utilization of an initial drilling method during the drilling process, having a fluid circulation, whereby the fluid medium may either be a liquid or air. Advantageous, for example, is the socalled air-lift drilling procedure.

The walling which has been installed during the drilling process and forming the final shoring of the shaft may, for example, consist of concrete rings or concrete segments which can be assembled into rings, or may comprise steel-pipe elements or steel-pipe segments, or of tubing sections or other suitable elements, whereby these, in case where necessary, may have large wall-thicknesses. The individual sections of the walling are connected in longitudinal direction, i.e., in the direction of the height of the shaft, in such a manner so that they form a continuous unit.

An advantageous form of equipment for sinking a shaft according the the above-disclosed method is provided with a drill head and an associated bearing for the lowermost sections of the walling or for a support element which is mounted on such lowermost section, or the like. Suitably, the drill head with the associated bearing for supporting the walling is constructed in such a manner so that can be removed from the shaft at the completion of the drilling process, or at any desired point in time, i.e., it may be moved upwards. This may be obtained, among others, in that the bearing for the walling contains movable sections each of which is movable from an operational position supporting the walling into an inner rest position without coming in contact with the walling and that the remaining section of the drill head has no larger outer dimensions than the free inner cross-section of the walling. If necessary, the walling can be held and retained by a device located above the shaft during the removal of the drill head from the shaft.

BRIEF DESCRIPTION OF DRAWINGS

FIG. 1 shows an apparatus for sinking a shaft, in operational position;

FIG. 2 shows a different embodiment of a drill head;

DESCRIPTION OF PREFERRED EMBODIMENT

Figure 3:
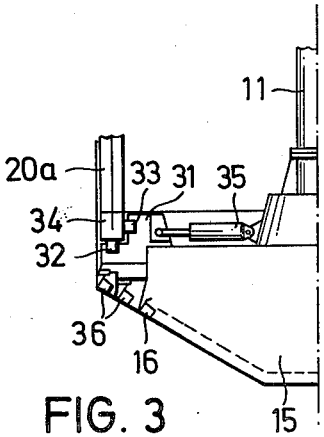
FIG. 3 shows a portion of the drill head according to FIG. 1 in enlarged form in operational position of the bearing for the support of the walling.

The apparatus shown in FIG. 1 is provided with a drill device 1 which is constructed to be moveable, and being equipped with a caterpillar-type drive gear. On a pole 3 is slidably guided a traverse element 4, having its end portions connected with hydraulic cylinders 5. The piston rods 6 of the latter are fastened on a bridge of the drill instrument 1 by means of a pin connection 8 or the like. This bridge 7 carries also the pole 3 and additionally is provided with lifting means 9, for example movable winches, cranes, single-rail suspension-trains or the like, by means of which the individual sections of the wallings to be installed in the shaft S can be moved to the working site and moved down into the shaft.

On the traverse element 4 is located a power swivel 10 for the rotational drive of a drill rod system 11 which is formed as an air lift rod system. Above the power swivel 10 there is placed a flush joint 12, which can be supplied with a flow medium through the inlet pipe 13, in a manner so that this can be guided downwardly in the sense of the arrows shown in the drawing through an annular space 11*a* of the drill rod system. Numeral 14 indicates an outlet pipe guided away from the flush joint 12, by means of which flushing medium which is loaded with the mass from the drilling and which rises through an inner conduit 11*b* of the rod system, can be discharged. The details of such a flush joint 12 as well as of a power swivel 10 may be of the prior art structure, as is known to a person familiar with the art.

At the lower end of the drilling rod system 11 there is mounted a drill head 15, which is provided with roller chissels 16 of which only some are illustrated, or with other suitable tools. The drill head 15 may especially be a socalled large diameter bit. The drill head is provided with outlets, or lead-passages 17 for the inflow of the flushing medium from the drill rod system 11 and with a medium sized opening 18 for removing the flushing medium loaded with the resultant mass from the drilling, as only shown in FIG. 1.

A shaft having the desired dimensions, for example with a diameter of 5 meters and a depth of 40 meters, will be advantageously produced in that the drill head 15 works out a drill-hole of the corresponding size in full rock formations or in mountains by means of rotational movement and downwardly-directed advancing movement, and in that simultaneously with the downwards movement of the drill head 15 there is moved down simultaneously a walling 20 which forms the final shoring for the shaft S. Depending on the drilling progress, further portions are emplaced from the top downwardly onto the sections 20*a* of the walling which has already been installed in the drilled hole, and which can be accomplished by means of the lifting tools 9. The portions 20*a* of the walling may for example be rings or annular segments consisting of concrete. Advantageously, the sections are connected with each other in axial direction in a manner so that there results an interconnected entity.

Figure 7:
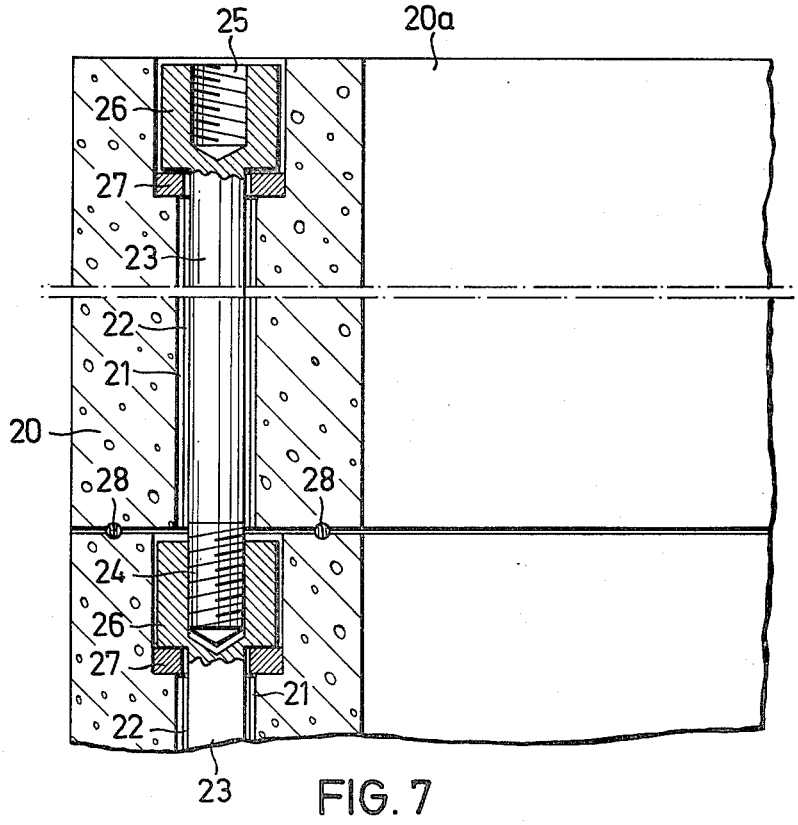
FIG. 7 shows a section of the walling in cross-section.

One embodiment for such a type of walling section 20*a* is shown in FIG. 7. Passage-openings 22 are located at points which are evenly distributed over the circumference of the concrete ring 20*a* and are delimited by a casing 21 which is embedded in concrete; with connection pins 23 being pushed through said passage openings. Each of the pins 23 is provided with an outer-threaded portion 24, which can be screwed into an inner threading 25 at the head 26 of the adjoined bolt in the concrete section 20*a* positioned therebelow. The heads 26 rest on plates 27. Numeral 28 denotes sealing elements.

On the bolt of the respective uppermost section 20*a* may temporarily be fastened sleeves 29 at opposite points, which slidingly engage on vertical rails 30 of the drilling apparatus 1 and thereby serve for securing the entire walling 20 against turning so that the same moves only translatorily downwards.

According to a preferred characteristic, the walling 20 finds its support on the drill bit 15 or on the sections associated with the same. For this purpose, there exist varying possibilities. As may be seen from FIGS. 1, 3 and 4, bearing sections 31 are proposed on the drill bit 15 at points which are distributed over the circumference of the drill bit, and are equipped with horizontal rollers 32 and vertical rollers 33. The latter form a bearing for the horizontal bottom side or for the vertical inside of a footing piece 34, which is fastened to the lowermost end portion of the lowermost walling sections 20*a*, or is formed by the same. The footing piece 34 may consist of steel, for example. The bearing piece 31 can be moved from the operational position shown in FIG. 3, in which it supports the walling 20, into a rest-position according to FIG. 4 radially to the inside, in which lies also its outermost point within the inside area of the shaft enclosed by the walling 20, by means of a pressure-element cylinder 35 which, via pipes (not shown) is supplied and controlled by the drilling instrument.

The bearing piece 31 is displaceable on suitable guides on the drill bit 15. When in an operative position, according to FIG. 3, the bearing piece 31 rests on fixed support areas on the drill bit in such a manner so that the weight of the walling 20 acts on the drill bit 15 through the bearing pieces and stresses the same. The bearing pieces themselves may also be provided with cutting rollers 36 or with other suitable tools so that there results the effect of under-cutters which drill the outer border area below the walling of the shaft to be produced. Also these tools 36 are arranged on the bearing pieces 31 in such a manner so that they are located in the inoperative position according to FIG. 4 within the contour of the walling 20. Corresponding lateral guide means on the drill bit 15 will guarantee that the forces originating from the cutting rollers 36 can be securely accepted.

The outer dimensions of the drill bit 15 are also smaller than the space enclosed inside by the walling 20. This means that the drill bit 15, when the bearing member 31 is in a rest-position, can be moved upwards or downwards, without interference, together with the drill rods carrying the same, through the walling of the shaft. In this manner, it is possible to remove the drill bit 15 in any case after completion of the drilling operation, i.e., after the desired depth of the shaft has been obtained.

Figure 4:
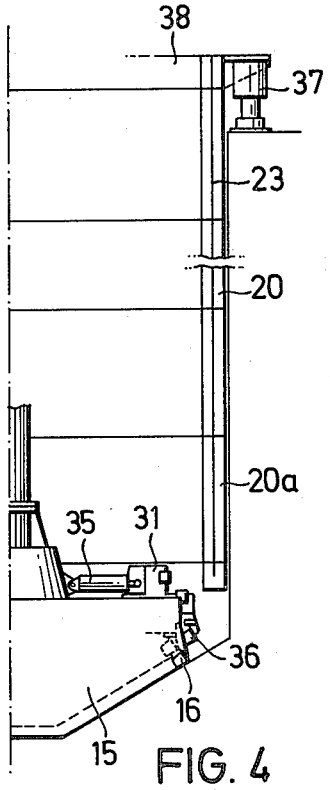
FIG. 4 shows a portion of the drill head according to FIGS. 1 and 3, wherein the bearing for the walling is in a rest-position.

As shown in FIG. 4, the walling 20, when necessary, such as during the pulling-in of the bearing piece 31, can be stopped and retained in the established position. For this purpose hydraulic support cylinders 37 are distributed around the upper shaft-opening engaging the outwardly protruding side of a traverse piece 38, which is screwed together with the anchor bolt 23. By means of this support cylinder 37, it will be possible to sink the walling 20 still deeper until it comes to rest on the sole of the shaft. Any differences of height in the circumference of the shaft opening can be corrected by means of the cylinders 37, when, as shown in FIG. 1, there exists no concrete-foundation 39. The drill bit 15, when needed, may obtain its pressing force also by means of the hydraulic cylinders 5 of the drilling apparatus 1 via the drill rod system 11, for example, in case where such a pressing becomes necessary or desired for operations which are performed separate from the walling 20 operation. In general, it is possible to lift or lower the power swivel 10 in a manner required for the adjusting or pulling of the drill rods 11. The drilling apparatus 1 may be provided with a prior art catch-device (not shown) for the rod system.

Figure 5:
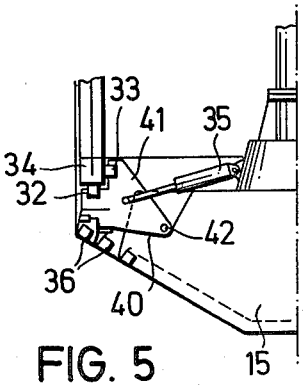
FIG. 5 shows an operational position according to FIG. 3 with a drill head according to FIG. 2.
Figure 6:
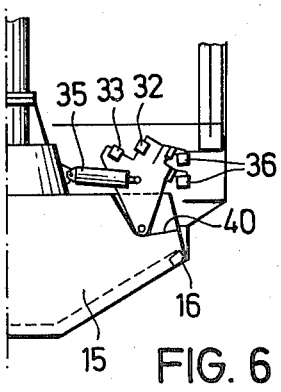
FIG. 6 shows a rest-position with a drill head according to FIGS. 2 and 5.

The above-mentioned holds true correspondingly also for the embodiments shown in FIGS. 2, 5 and 6. The bearing pieces 41 proposed here are guided on the drill bit 15 by means of pins 42 and may be tilted upwards with the aid of pressure-cylinders 35 from the operational position according to FIG. 5, in which they support themselves on an area 40 on the drill bit 15, being tilted upwards in the rest position according to FIG. 6 in which again are positioned the outermost points of these bearing pieces and the drill bit within a space enclosed by the walling 20. Numeral 36 denotes here again the cutting rollers.

Figure 8:
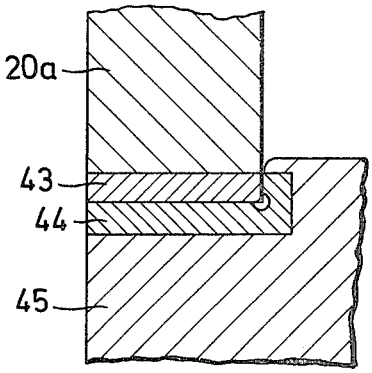
FIGS. 8 and 9 show two different embodiments of the bearing for the support of the walling.
Figure 9:
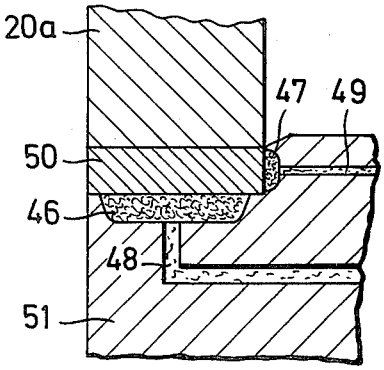

In place of a roller bearing for the lower end portion of the walling 20, as shown in FIGS. 1 to 6 at rollers 32 and 33, there may also be proposed a different type of bearings. Thus, FIG. 8 shows a slide bearing in which at the lower end of the lowermost section 20*a* of the walling there is attached a glide plate 43 which lies opposite a slide member 44 on a bearing piece 45. The slide plate 43 and slide member 44 consist of wear-resistant materials having good sliding characteristics, thus, for example, a synthetic material such as PTFE. FIG. 9 shows an embodiment using a hydrostatic bearing, wherein numerals 46 and 47 denote chambers for receiving a suitable medium, especially grease, whereby such a medium can be supplied to said chambers by means of channels 48 and 49. These channels are located in the respective bearing piece 51, while the associated walling section 20*a* is provided with a bearing plate.

Disregarding the bearing structure in general, the embodiment may also be such that in place of moveable bearing pieces on the drill bit there may be provided an annular cutting shoe or the like, which drills the area below the walling 20, as is accomplished in the bearing pieces 31 and 41 by means of the cutting rollers 36. This cutting shoe or cutting circle may be connected with the drill bit in a manner so that at the completion of the drilling operation, when the desired depth of the shaft is obtained, it can be disconnected from the drill bit. The cutting shoe remains then in the shaft, while the drill bit, having dimensions which are smaller than the inner diameter of the walling, may be lifted out of the shaft together with the rod system. The coupling between the drill bit and the cutting shoe may, for example, also be shaped as a bayonet-type closing which, during rotation of the drill rods with the drill bit, turns in a rotational direction counter to the normal rotational direction during the drilling, so that then the connection between both members is released and the drill bit may be pulled.

All characteristics mentioned in the above disclosure and illustrated in the drawings should be considered in themselves or also in combination as part of this invention, in so far as the state of the art permits.

What I claim is:

1. An apparatus for sinking shafts comprising a drill bit and a bearing associated with said drill bit for supporting of at least one walling section forming a shoring for the shaft and which is inserted into the shaft simultaneously with the drilling thereof characterized in that the bearing associated with the drill bit contains a plurality of bearing pieces of which each is movable from an operational position for supporting the walling section into a rest-position without contacting the walling.

2. The apparatus according to claim 1, characterized in that the bearing pieces are generally radially displaceable.

3. The apparatus according to claim 1, characterized in that the bearing pieces are pivotal.

4. The apparatus according to claim 1, characterized in that the bearing pieces are provided with cutting tools.

5. The apparatus according to claim 1, characterized in that the outer dimensions of of the drill bit exclusive of the bearing for the walling are smaller than the inner dimensions of the walling.

6. The apparatus according to claim 1, characterized in that the drill bit is a flushing drill bit.

7. The apparatus according to claim 1, characterized by devices for securing the walling section against rotation.

8. The apparatus according to claim 1, characterized by a device for holding the walling in a suspended position.

9. The apparatus according to claim 8, characterized in that the device is provided with elements for adjusting the vertical position of the walling section.

10. An apparatus for sinking shafts comprising a drill bit and a bearing associated with said drill bit for supporting of at least one walling section forming a shoring for the shaft and which is inserted into the shaft simultaneously with the drilling thereof including a drill-rod system, a power swivel connectable to the upper end portion of said drill-rod system, and means for vertically moving the power swivel.

11. A method of drilling a shaft using a rotary drill bit wherein ring-like walling sections are sequentially inserted into the shaft one upon another simultaneously with the drilling operation to form a shoring for the shaft, the method including the steps of:

peripherally loading the drill bit during drilling by supporting the undersurface of the lowermost walling section on radially inwardly retractable members located at the periphery of the drill bit, preventing the walling sections from rotating while allowing said sections to move down the shaft with the drill bit and radially inwardly retracting said members when drilling is completed to within the perimeter of the walling sections to permit withdrawal of the drill bit from the shaft.

12. The method of claim 11 including sequentially inserting a series of said ring-like sections into the shaft one above another, as dictated by the depth of the shaft and connecting said sections together.

13. The method of claim 12 including connecting the walling sections together as they are inserted into the shaft.

* * * * *